US009675986B2

(12) United States Patent
Kang

(10) Patent No.: US 9,675,986 B2
(45) Date of Patent: Jun. 13, 2017

(54) CONTENTS DISPENSING PUMP

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 0 days.

(21) Appl. No.: 14/899,542

(22) PCT Filed: Jun. 25, 2013

(86) PCT No.: PCT/KR2013/005602
§ 371 (c)(1),
(2) Date: Dec. 17, 2015

(87) PCT Pub. No.: WO2014/204034
PCT Pub. Date: Dec. 24, 2014

(65) Prior Publication Data

US 2016/0136670 A1 May 19, 2016

(30) Foreign Application Priority Data

Jun. 18, 2013 (KR) ..... 10-2013-0069816

(51) Int. Cl.
*B05B 11/00* (2006.01)
*B65D 83/00* (2006.01)

(52) U.S. Cl.
CPC ..... *B05B 11/3047* (2013.01); *B05B 11/00* (2013.01); *B05B 11/3028* (2013.01); *B05B 11/3046* (2013.01); *B05B 11/3074* (2013.01); *B65D 83/00* (2013.01); *B05B 11/3033* (2013.01)

(58) Field of Classification Search
CPC . B05B 11/3047; B05B 11/00; B05B 11/3074; B05B 11/3046; B05B 11/3028; B05B 11/3033; B65D 83/00
USPC ..... 222/383.1, 383.3, 340, 321.1, 321.7, 222/321.8
See application file for complete search history.

(56) References Cited

FOREIGN PATENT DOCUMENTS

| | | | | |
|---|---|---|---|---|
| FR | EP 1939111 A1 * | 7/2008 | ..... | B05B 11/0072 |
| JP | 09-225361 A | 9/1997 | | |
| JP | 2010-047295 A | 3/2010 | | |
| KR | 20-0380613 Y1 | 3/2005 | | |
| KR | 20-0405398 Y1 | 1/2006 | | |
| KR | 10-2011-0068196 A1 | 6/2011 | | |

* cited by examiner

*Primary Examiner* — Donnell Long
(74) *Attorney, Agent, or Firm* — East West Law Group; Heedong Chae

(57) ABSTRACT

A contents dispensing pump is coupled to a container for accommodating the contents therein and dispenses a fixed quantity of the contents through a pumping operation. A push button that is depressed deforms a deformed pressing member, reducing the volume of a temporary reservoir and increasing pressure therein. A valve plate closes a contents outlet and a valve protrusion wheel is widened by the increased pressure such that the contents contained in the temporary reservoir are dispensed through an outlet.

18 Claims, 14 Drawing Sheets

Prior Art

Prior Art

CONTENTS DISPENSING PUMP

TECHNICAL FIELD

The present invention relates to a contents dispensing pump which is mounted on a container so as to dispense, to the outside, contents contained in the container by a fixed quantity through a pumping operation, and particularly, to a contents dispensing pump which can allow a deformed pressing member to serve as a cylinder and an opening and closing valve to simplify a structure of the contents dispensing pump so that the productivity is improved and the product price is lowered, and at the same time, be easily mounted on a product having a small space in which the dispensing pump is to be mounted, by performing a pumping operation by changing the volume of a temporary contents reservoir due to a deformation of the deformed pressing member such that a working stroke distance of the dispensing pump can be short.

BACKGROUND ART

In general, as one means for dispensing a suitable amount of contents, such as cosmetics, shampoo, or detergent, contained in a container, a dispensing pump is mounted, on a container for use.

The dispensing pumps according to the related art, which are mounted on a container and used, to dispense a small amount of contents as described above, have been variously proposed. As shown in FIGS. 1 and 2, a general contents dispensing pump includes a pump body 110 in which an opening and closing ball 122, an operating piston 123 elastically supported by a spring, and a cylinder 120 for allowing the contents in a contents storing chamber 126 to be dispensed through a push button 140 by generating pressure in the contents storing chanter 126 with the operating piston 123 are installed.

An air-tight piston 124 is further installed to the operating piston 123 and the push button 140 is installed in an operating tube 130 coupled to the operating piston 123 of the cylinder 120.

According to the above-described contents dispensing pump of the related art, when the push button 140 is pushed, an air gap is generated between the air-tight piston 124 and the operating piston 123. In this case, a pressure is generated in the contents storing chamber 126 while the air-tight piston 124 and the operating piston 123 together move down, so that the contents are dispensed through a contents transferring passage 123*a* of the operating piston 123 due to the pressure.

In this case, the opening and closing ball 122 is tightly closed to a contents introducing passage 125 by the compressed spring 121 so that the contents introducing passage 125 is closed.

After the push button 140 is pushed to dispense contents as described above, when the pushed button 140 is released from the external force applied thereto, as shown in FIG. 2, the operating piston 123 and the air-tight piston 124 move up together due to the repulsive elastic force accumulated in the spring 121.

At the initial lifting stage of the operating piston 123 and the air-tight piston 124 ascending as described above, while the air-tight piston 124 is stooped ascending due to the friction with an inside of the cylinder 120, the operating piston 123 first moves up to close the air gap between the operating piston 123 and the air-tight piston 124, so that the contents transferring passage 123*a* is closed and the elastic force accumulated in the spring 121 is weakened.

In the state that the contents transferring passage 123*a* is shut off, when the operating piston 123 and the air-tight piston 124 are continuously lifted up, a vacuum pressure is generated in the contents storing chamber 125 and the opening and closing ball 122 is spaced apart from the contents introducing hole 125 due to the vacuum pressure generated in the contents storing chamber 126, so that the contents in the container are introduced into the contents storing chamber 126.

The contents dispensing pump according to the related art dispenses the contents while repeatedly performing the above-described operation.

However, the contents dispensing pump has a major drawback that, since a metallic ball and metallic spring are used as the opening and closing means for dispensing contents, the metallic ball and metallic spring are corroded due to spherical reaction with the contents so that the contents are polluted. In addition, since synthetic resin and metal are used as materials of the contents dispensing pump, when the used contents dispensing pump is discarded, it is difficult to separate the synthetic resin and metallic materials from each other, so that it is difficult to perform resource recycling.

Specifically, the structure of the contents dispensing pump according to the related art is complex, so that the productivity is deteriorated and the product price is increased. In addition, since the dispensing pump structurally has a long working stroke distance, when the dispensing pump is applied to a product such as a compact having a height less than a width thereof, it is difficult to mounting the dispensing pump on the product due to a small mounting space. When the dispensing pump according to the related art is manufactured to have a small size in order to solve the problem, the dispensing amount of contents is too small, there is required to repeat pumping several times to obtain a desired amount of contents.

DISCLOSURE

Technical Problem

To solve the problems described above, an object of the present invention is to provide a contents dispensing pump, in which opening and closing means for dispensing contents is formed of an elastic material such as rubber or synthetic resin durable to a chemical material to be prevented from being corroded due to the contents, and any valve means formed of a metallic material are not used in the contents dispensing pump so that the used contents dispensing pump can be recycled.

Another object of the present invention is to provide a contents dispensing pump which has a simple structure to be easily manufactured so that the productivity is improved and the product price is reduced.

Still another object of the present invention is to provide a contents dispensing pump of which a working stroke distance is shortened so that the contents dispensing pump can be easily applied to a product such as a compact having a height less than a width thereof.

Technical Solution

To achieve the objects, the present invention provides a contents dispensing pump which is coupled to a container for containing the contents therein to dispense the contents, wherein a deformed pressing member (60) descends by being pressed and deformed when a push button (50) descends such that the volume of a temporary reservoir (TR) is reduced and pressure is generated in the temporary reservoir (TR). Thus, a valve plate (40) closes a contents outlet (242), and a valve protrusion wheel (62) coming into close contact with, a contents opening and closing piece (513) is widened by the pressure such that the contents contained in the temporary reservoir (TR) are dispensed through, an outlet (51) while passing through a gap between the contents opening and closing piece (513) and the valve protrusion wheel (62). Then, when the pressure that presses the push button (50) is removed, while the push button (50) lifts up by a restoring force of an elastic member (70), the deformed pressing member (60) pressed by the push button (50) is restored to the original state. Thus, the pressure generated within the temporary reservoir (TR) disappears and vacuum pressure is generated, so that the gap between the contents opening and closing piece (513) and the valve protrusion wheel (62) of the deformed pressing member (60) is closed and the central part of the valve plate (40) is lifted by the vacuum pressure to widen boundary lines of opening and closing lines (41). Thus, the contents contained in the container (10) move to the temporary reservoir (TR) through a gap between the valve plate (40) and the contents outlet (242), and in this case, the contents that have passed through the contents outlet (242) move to the temporary reservoir (TR) through gaps of the widened opening and closing lines (41) of the valve plate (40). When the contents are transferred so that the vacuum pressure of the temporary reservoir (TR) disappears, while the opening and closing line (41) opened due to the autonomous elastic force is restored into the original state to be closed so that the valve plate (40) closes the contents outlet (242).

Furthermore, according to a first embodiment of the present invention, there is provided the contents dispensing pump which is coupled to a container for containing the contents therein to dispense the contents, which includes a valve body (20), the valve plate (40), the push button (50), the deformed pressing member (60), and the elastic member (70), wherein the valve body (20) includes a valve upper body (22) and a valve lower body (24), wherein the valve upper body (22) has a receiving sill (222) on the upper surface thereof and a valve plate support sill (224) protruding from the middle part of the inner side thereof, and the valve lower body (24) has the contents outlet (242) in the center thereof and a ring-shaped protrusion (244) protruding from the vicinity of the outer side of the contents outlet (242), wherein the valve lower body (24) is coupled to the valve upper body (22).

The valve place (40) is coupled between the valve upper body (22) and the valve lower body (24) of the valve body (20), and the plurality of opening and closing lines (41) are formed.

The push button (50) is coupled to the outer periphery portion of the valve upper body (22), has an outlet (51), from which the contents are dispensed, formed in the center thereof. A plurality of ribs (511) is formed inside the outlet (51) and a contents opening and closing piece (513) is integrally formed on lower ends of the ribs (511).

The deformed pressing member (60) is coupled to the inside of the push button (50), has a coupling sill 64 protruding from the outer periphery thereof so as to be mounted on the receiving sill (222) of the valve upper body (22), and has the valve protrusion wheel (62) in the center thereof.

The elastic member (70) is positioned over the coupling sill (64) of the deformed pressing member (60) so as to press and fix the coupling sill (64) of the deformed pressing member (60) to the receiving sill (222) of the valve upper body (22), thereby increasing airtightness and at the same time, elastically supporting the push button (50).

Advantageous Effects

According to the present invention, the opening and closing means for dispensing contents by pushing the push button is formed of an elastic material such as rubber or synthetic resin durable to a chemical material so that the opening and closing means can be prevented from being corroded due to the contents. In addition, any valve means formed of a metallic material are not used in the contents dispensing pump so that the used contents dispensing pump can be recycled.

Specifically, the contents dispensing pump has a simple structure to be easily manufactured so that the productivity can be improved and the product price can be reduced.

In addition, the contents dispensing pump has a short working stroke distance so that the contents dispensing pump can be easily applied to a product such as a compact having a height less than a width thereof.

BEST MODE

[Mode for Invention]

It should be understood that the terms used in the specification and the appended claims should not be construed as listed to general and dictionary meanings, but interpreted based on the meanings and concepts corresponding to technical aspects of the present invention on the basis of the principle that the inventor is allowed to define terms appropriately for the best explanation.

Figure 1:
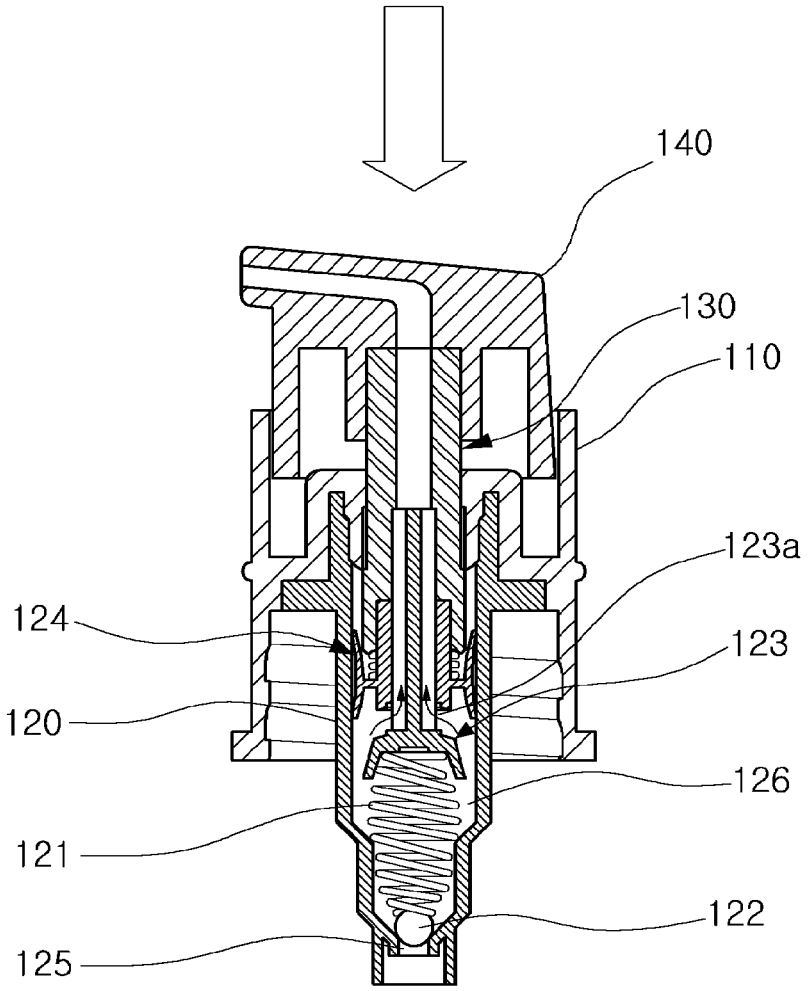
FIG. 1 is a view illustrating an exemplary state that a contents, dispensing pump is operated to dispense contents according to the related art.
Figure 2:
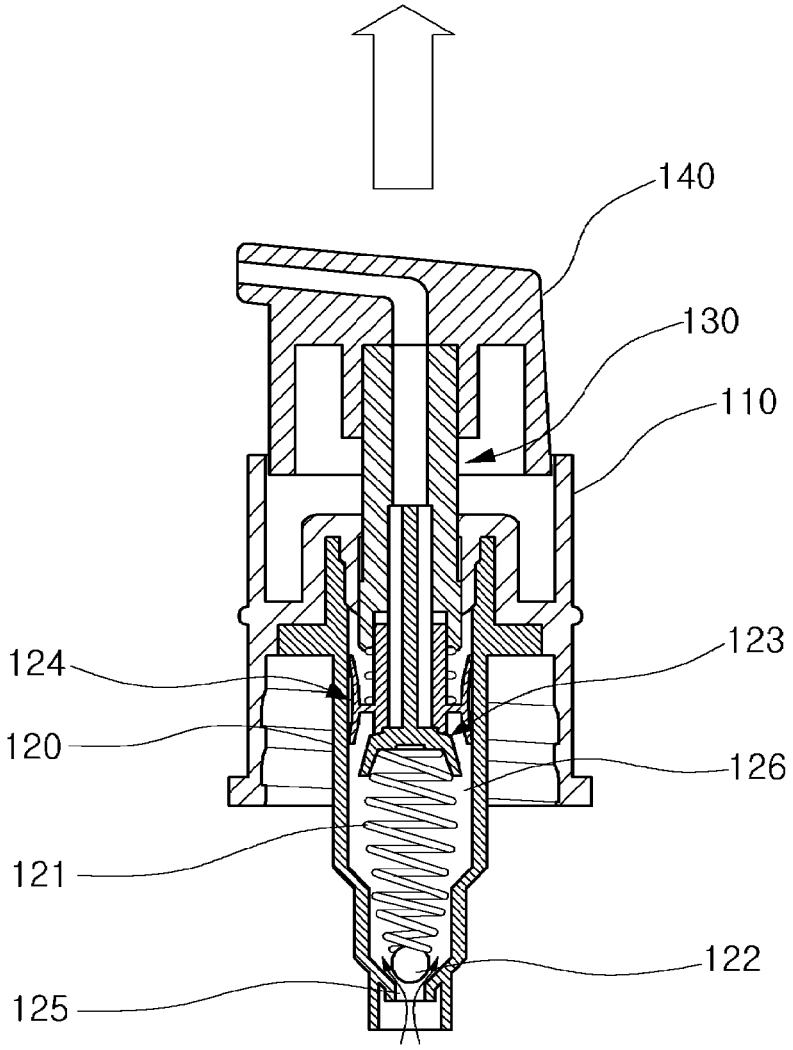
FIG. 2 is a view illustrating an exemplary state that a contents dispensing pump is restored to an original state when force is removed from the contents dispensing pump according to the related art.
Figure 3:
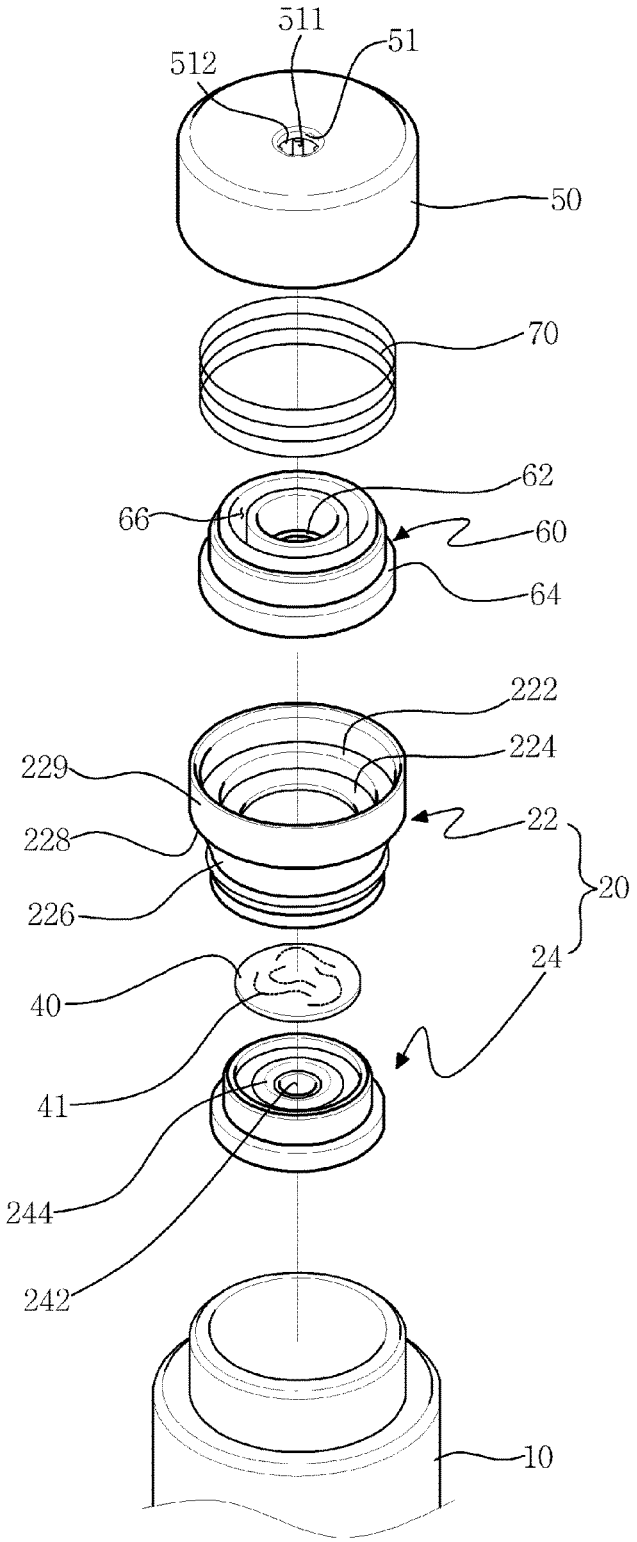
FIG. 3 is an exploded perspective view showing a contents dispensing apparatus according to a first embodiment of the present invention.
Figure 4:
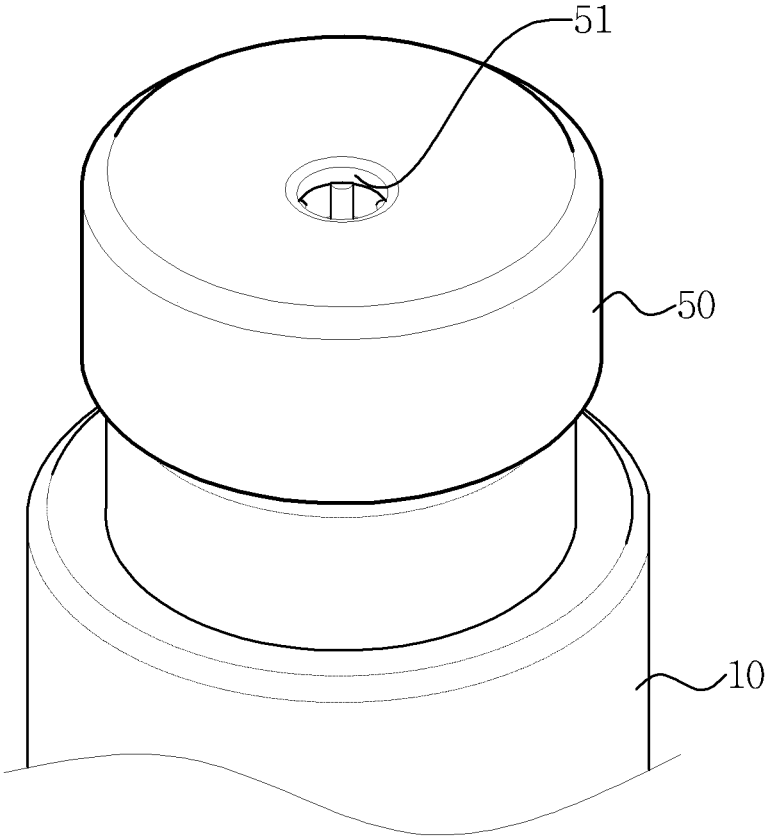
FIG. 4 is an assembled perspective view showing the contents dispensing pump according no the first embodiment of the present invention.
Figure 5:
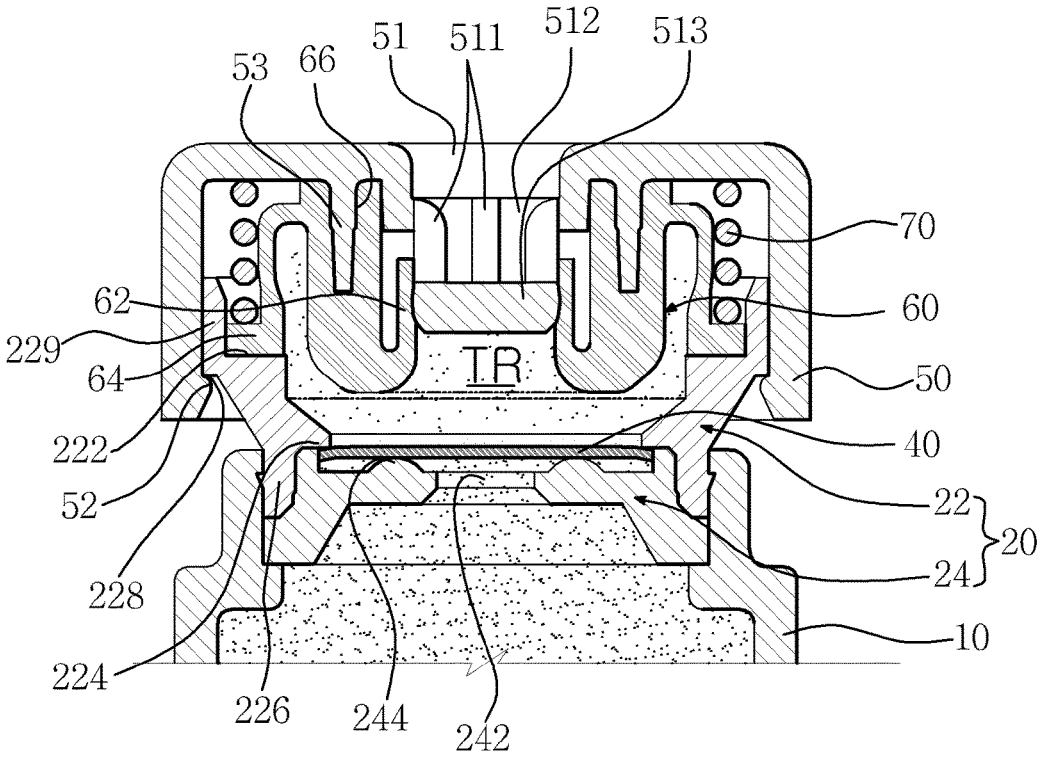
FIG. 5 is an assembled sectional view showing the contents dispensing apparatus according to the first embodiment of the present invention.
Figure 6:
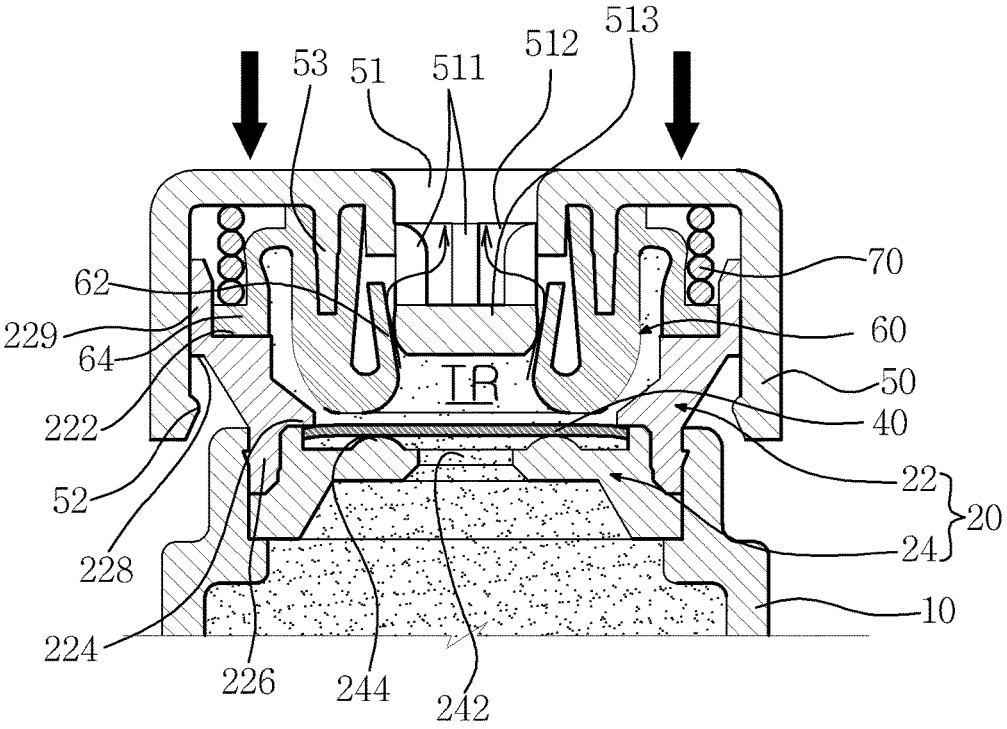
FIG. 6 is a sectional view showing a state that the contents dispensing pump according to the first embodiment of the present invention is operated to dispense contents.
Figure 7:
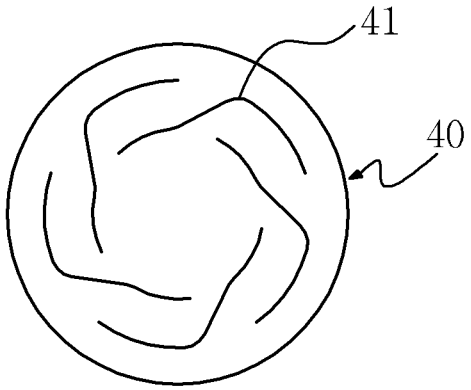
FIG. 7 is a plan view of a valve plate applied to the present invention.
Figure 8:
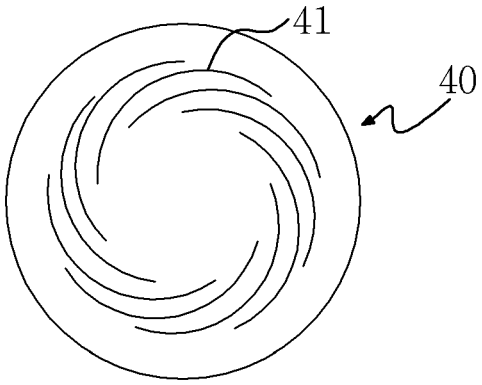
FIGS. 8 and 9 are views showing other examples of the valve plate applied to the present invention.
Figure 9:
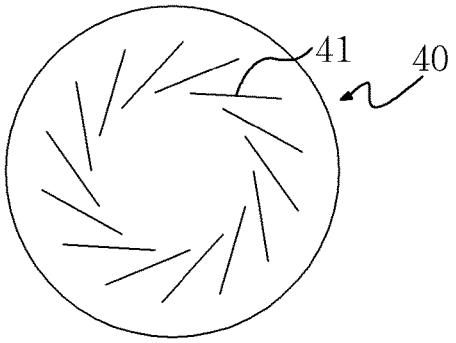
Figure 10:
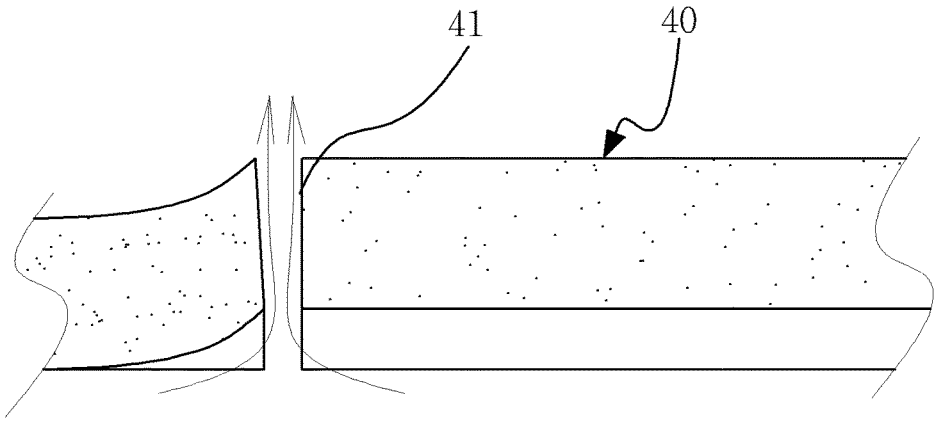
FIG. 10 is a sectional view showing an operating state of opening and closing lines of the valve plate applied to the present invention.
Figure 11:
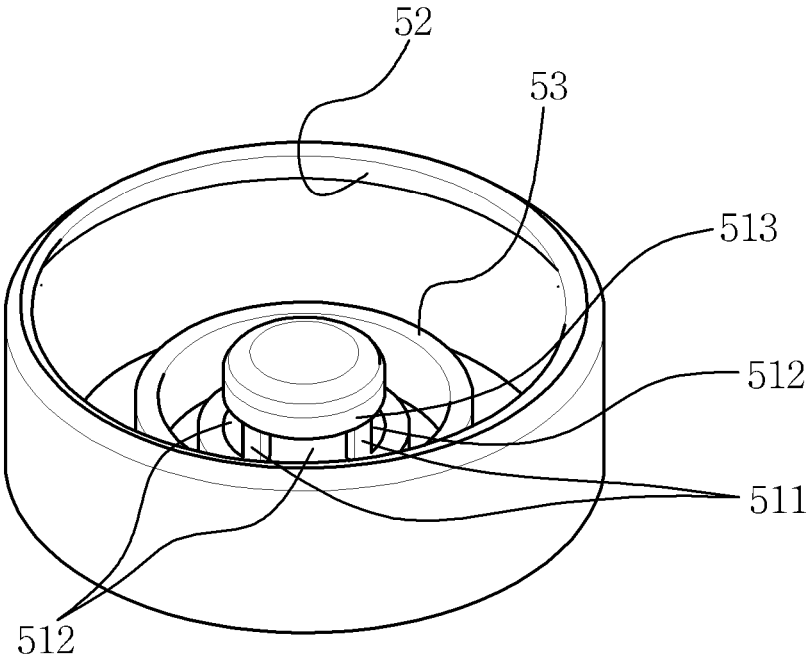
FIG. 11 is a perspective bottom view of a push button applied to the contents dispensing pump according to the first embodiment of the present invention.
Figure 12:
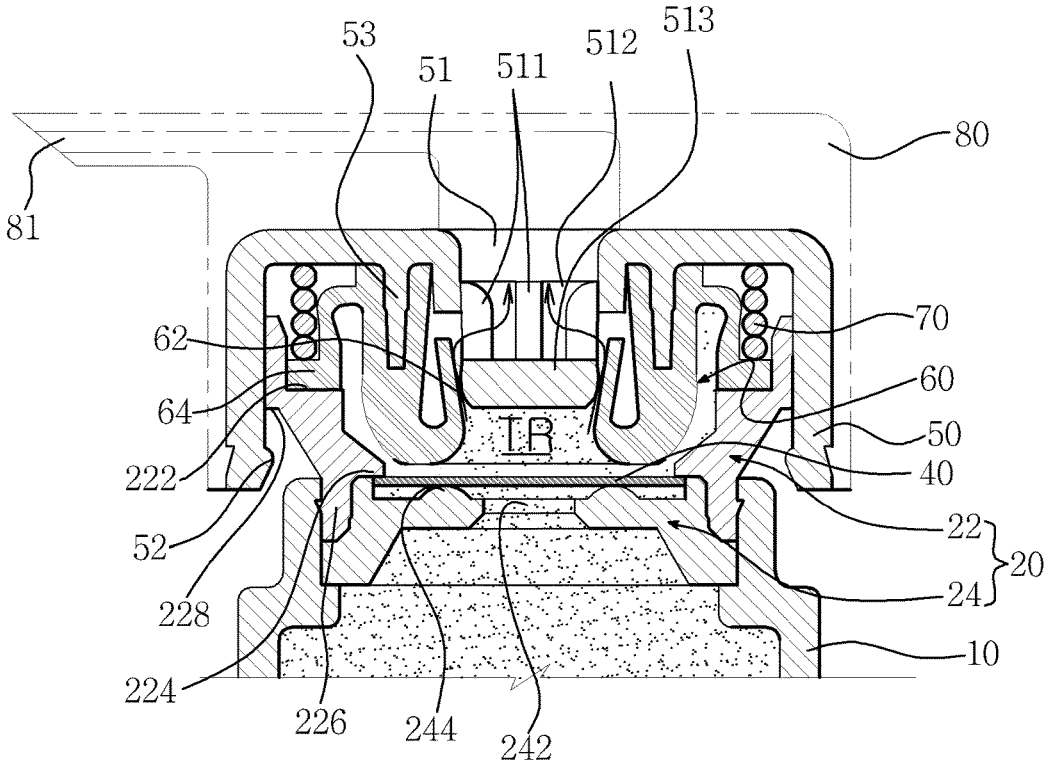
FIG. 12 is a view showing an exemplary state that a nozzle button is further coupled to the contents dispensing pump according to the first embodiment of the present invention.

FIG. 3 is an exploded perspective view showing a contents dispensing apparatus according to a first embodiment of the present invention. FIG. 4 is an assembled perspective view showing the contents dispensing pump according to the first embodiment of the present invention. FIG. 5 is an assembled sectional view showing the contents dispensing apparatus according to the first embodiment of the present invention. FIG. 6 is a sectional view showing a state that the contents dispensing pump according to the first embodiment of the present invention is operated to dispense contents. FIG. 7 is a plan view of a valve plate applied to the present invention. FIGS. 8 and 9 are views showing other examples of the valve plate applied to the present invention. FIG. 10 is a sectional view showing an operating state of opening and closing lines of the valve plate applied to the present invention. FIG. 11 is a perspective bottom view of a push button applied to the contents dispensing pump according to the first embodiment of the present invention. FIG. 12 is a view showing an exemplary state that a nozzle button is further coupled to the contents dispensing pump according to the first embodiment of the present invention.

Hereinafter, various embodiments according to the present invention will be described in detail with reference to accompanying drawings.

A contents dispensing pump according to the first embodiment of the present invention will be described as follows.

As shown in FIGS. 3 to 5, the contents dispensing pump according to the first embodiment of the present invention is coupled to a container 10 for containing contents therein and includes a valve body 20, a valve plate 40, a push button 50, a deformed pressing member 60 and an elastic member 70.

The valve body 20 includes a valve upper body 22 and a valve lower body 24. The valve upper body 22 has a receiving sill 222 on an upper surface thereof, a valve plate support sill 224 protruding from the middle part of an inside thereof, a coupling part 226 extending downwardly, and a latching sill 228 formed on an outer circumference thereof. An extension protrusion wheel 229 may extend upwardly of the valve body 20 to be integrally formed with the valve body 20. The extension protrusion wheel 229 may serve as a guide to enable the deformed pressing member 60 and the elastic member 70 to be in place on the valve upper body 22.

The valve lower body 24 has a contents outlet 242 formed in the center thereof and a ring-shaped protrusion 244 protruding from the vicinity of the outside of the contents outlet 242. The valve lower body 24 is coupled to the valve upper body 22 by being inserted into a valve lower body coupling part 226 of the valve upper body 22 after the valve plate 40 is placed thereon.

The valve lower body 24 may be coupled to the valve upper body 22 through an undercut coupling, forcible fitting or thermal bonding scheme. When the valve lower body 24 is coupled to the valve upper body 22 by being inserted into a valve lower body coupling part 226 of the valve upper body 22 while the valve plate 40 is placed on the valve lower body 24, the valve plate 40 is allowed to be tightly closed to the ring-shaped protrusion 244 of the valve upper body 22 by allowing the valve plate support sill 224 of the valve upper body 22 to press the outer periphery portion of the valve upper body, so that the contents outlet 242 is closed.

The valve plate 40 has a plate shape. The valve plate 40 is coupled between the valve upper body 22 and the valve lower body 24 of the valve body 20, so that the plurality of opening and closing lines 41 are formed thereon.

The valve plate 40 may be formed of one of general rubber, elastomer, silicon rubber, NBR rubber and synthetic resin.

The opening and closing line 41 may be a wave-shaped cutting line as shown in FIG. 7, an arc-shaped cutting line as shown in FIG. 8 or a diagonal line shaped cutting line as shown in FIG. 9. But, the opening and closing line 41 is not limited, to a particular shape and if the opening and closing line 41 is opened or closed by the elasticity of the valve plate 40, any shaped cutting lines may be used as the opening and closing line 41.

When the push button 50 is pressed to generate a pressure within a temporary reservoir TR, since the valve plate 40 is tightly closed to the ring-shaped protrusion 244 of the valve lower body 24, the boundary line of the opening and closing line 41 is closed. When the pressed push button 50 is released such that the push button 50 lifts up by the elastic member 70 to generate the vacuum pressure in the temporary reservoir TR, as shown in FIG. 10, the central part of the valve plate (40) is lifted to widen the boundary line of the opening and closing line 41, so that the contents are provided from the container 10 to the temporary reservoir TR through the gap of the opening and closing line 41.

The push button 50 is coupled to the outer periphery portion of the valve upper body 22, has the outlet 51, from which the contents are dispensed, formed in the center thereof and a latching sill 52 formed on a lower end of an inner periphery thereof. In addition, a plurality of ribs 511 is formed inside the outlet 51 and a contents opening and closing piece 513 is integrally formed on lower ends of the ribs 511. A contents passage 512 is formed between the ribs 511, such that the contents are dispensed from the temporary reservoir TR to the outlet 51 through the contents passage 512.

When the push button 50 covers the valve upper body 22, the valve tipper body 22 is forcibly fitted with the push button 50, such that the latching sill 52 is latched to a latching sill 288 while passing through an outer periphery of the extension protrusion wheel 229.

As shown in FIG. 11, a coupling rib 53 is formed inside the push button 50 and coupled to the deformed pressing member 60.

The deformed pressing member 60 is coupled to the inside of the push button 50, and has a coupling sill 64 protruding from the outer periphery thereof to be mounted on the mounting sill 222 of the valve upper body 22, and a valve protrusion wheel 62 formed in the center thereof.

The deformed pressing member 60 is mounted on the valve upper body 22, so that an inner space is formed between the deformed pressing member 60 and the valve body 20. The inner space is the temporary reservoir TR in which the contents remain until the contents are dispensed through the outlet 51 of the push button 50 after moving from the container 10 thereto through the valve body 20.

A coupling groove 66 is formed on an upper surface of the deformed pressing member 60 and the coupling rib 53 of the push button 50 is inserted into the coupling groove 66 so that the deformed pressing member 60 is coupled to the push button 50. The coupling rib 53 and the coupling groove 66 may be coupled to each other through an undercut coupling, forcible fitting or thermal bonding scheme or by using adhesive.

After the coupling sill 64 of the deformed pressing member 60 is placed on the receiving sill 222 of the valve upper body 22, the coupling sill 64 of the deformed pressing member 60 is pressed by using the elastic member 70 such that the coupling sill 64 of the deformed pressing member 60 is tightly closed to the receiving sill 222 of the valve upper body 22. In this case, the extension protrusion, wheel 229 of the valve upper, body 22 serves as a guide to enable the receiving sill 64 of the deformed pressing member 60 to be suitably positioned.

A valve protrusion wheel 62 of the deformed pressing member 60 has a cylindrical shape. The contents opening and closing piece 513 of the push button 50 is tightly fitted into the valve protrusion wheel 62 to control the dispensing of the contents. It is preferable that a diameter of the valve protrusion wheel 62 is less than that of the contents opening and closing piece 513 to allow the valve protrusion wheel 62 to press the contents opening and closing piece 513. Preferably, the diameter of the valve protrusion wheel 62 is less than that of the contents opening and closing piece 513 by 0.1 mm to 5.0 mm.

Thus, when the push button 50 is not pressed, the pressure is not generated in the temporary reservoir TR, so that the valve protrusion wheel 62 continues to press the contents opening and closing piece 513 due to the autonomous elasticity and maintains the closing state. However, as shown in FIG. 6, when the push button 50 is pushed to increase the pressure in the temporary reservoir TR, the valve protrusion wheel 62 pressing the contents opening sine closing piece 513 is opened due to the pressure so that the contents are dispensed.

The deformed pressing member so may be formed of one of general rubber, elastomer, silicon rubber, NBR rubber and synthetic resin having excellent elasticity.

The elastic member 70 is placed, on the coupling sill 64 formed on an edge of the deformed pressing member 60. The elastic member 70 fixes the coupling sill 64 of the deformed pressing member to the receiving sill 222 of the pump upper body 22 while pressing the coupling sill 64 to improve tightness and at the same time, to elastically support the push button 50. The elastic member 70 may include a coil spring.

The elastic member 70 may be formed of one of synthetic resin, elastomer, robber and a metallic material. If the elastic member 70 may be formed of the same material as those of any other elements, such as synthetic resin, elastomer or rubber, when the used contents dispensing pump of the present invention is discarded, the contexts dispensing pump may be separated to be recycled.

In addition, as shown in FIG. 12, the contents dispensing pump according to the present invention way further include a nozzle button 80 having a nozzle 81 provided on the push button 50.

The operation of the present invention, configured as described above is as follows.

The contents dispensing pump according to the present invention may be coupled to a container 10 for containing contents for use. The contents dispensing pump according to the present invention may be applied to a general cosmetic container, home item container, a food container, a medicine container and may be easily applied to a packing container having a height less than a width such as a compact.

As shown in FIG. 6, according to the contents dispensing pump of the present invention, when the push button 50 descends, the deformed pressing member 60 descends while being pressed to be deformed. In this case, since the elastic member 70 is pressed in the state that the coupling sill 64 of the deformed pressing member 60 is placed on the receiving sill 222 of the valve upper body 22, the coupling sill 64 of the deformed pressing member 60 is fixed and the air tightness is enhanced.

When the push button 50 descends, although the coupling sill 64 of the deformed pressing member 60 is fixed, other parts except for the coupling sill 64 move down by a predetermined distance.

Thus, since the pressure is generated in the temporary reservoir TR while the volume of the temporary reservoir TR is reduced, the valve plate 40 is tightly closed to the ring-shaped protrusion 244 near the contents outlet 242, in addition, while the valve protrusion wheel 62 tightly closed to the contents opening and closing piece 513 is opened by the pressure, the contents in the temporary reservoir TR pass between the contents opening and closing piece 513 and the valve protrusion wheel 62, so that the contents are dispensed through the contents passage 512 and the outlet 51.

Then, when the force pressing the push button 50 is removed, while the push button 50 moves up due to the restoring strength of the elastic member 70, the deformed pressing member 60 pushed by the push button 50 is restored into the original state.

Thus, as the pressure generated in the temporary reservoir TR disappears, the valve protrusion wheel 62 of the deformed pressing member 60 is tightly closed to the contents opening and closing piece 513 again, so that the valve protrusion wheel 62 is tightly closed to the content opening and closing piece 513.

Thereafter, when the push button 50 continuously moves up to generate the vacuum pressure in the temporary reservoir TR, as shown in FIG. 10, the valve protrusion wheel 62 of the deformed pressing member 60 and the contents opening and closing piece 51*c* are tightly closed to each other and the central part of the valve plate 40 lifts up due to the vacuum pressure, so that the bound line 41 is opened while being lifted up.

Thus, the contents are transferred into the container 10 through a gap between the valve plate 40 and the contents outlet 242. Then, the contents passing through the contents outlet 242 are transferred into the temporary reservoir TR through the gap of the opening and closing line 41 of the valve plate 40.

When the contents are transferred so that the vacuum pressure of the temporary reservoir TR disappears, while the opening and closing line 41 opened due to the autonomous elastic force is restored into the original state to be closed so that the valve plate 40 closes the contents outlet 242.

Next, the contents dispensing pump according to the second embodiment of the present invention, will be described.

Figure 13:
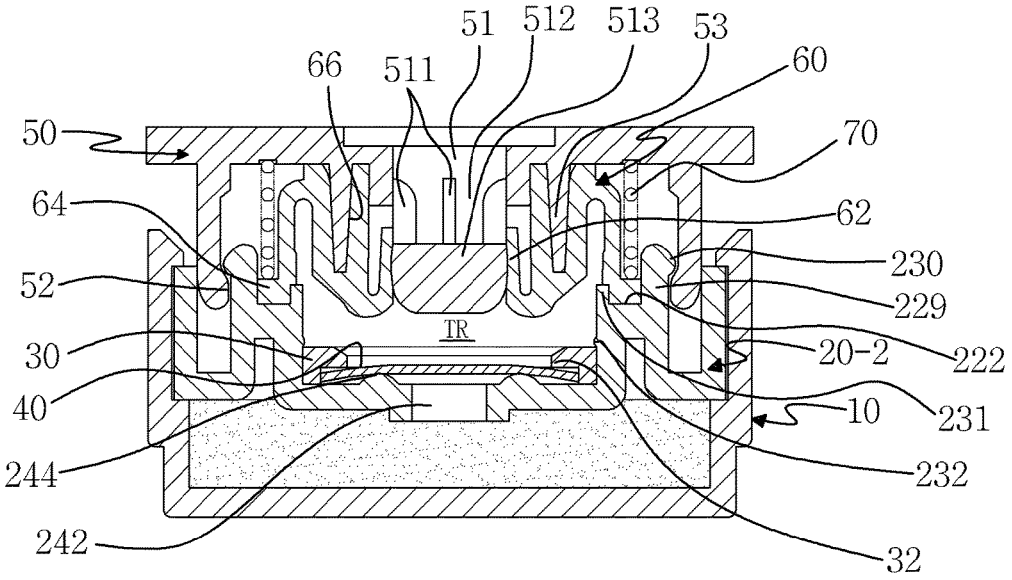
FIG. 13 is an entire sectional view allowing a contents dispensing pump according to a second embodiment of the present invention.
Figure 14:
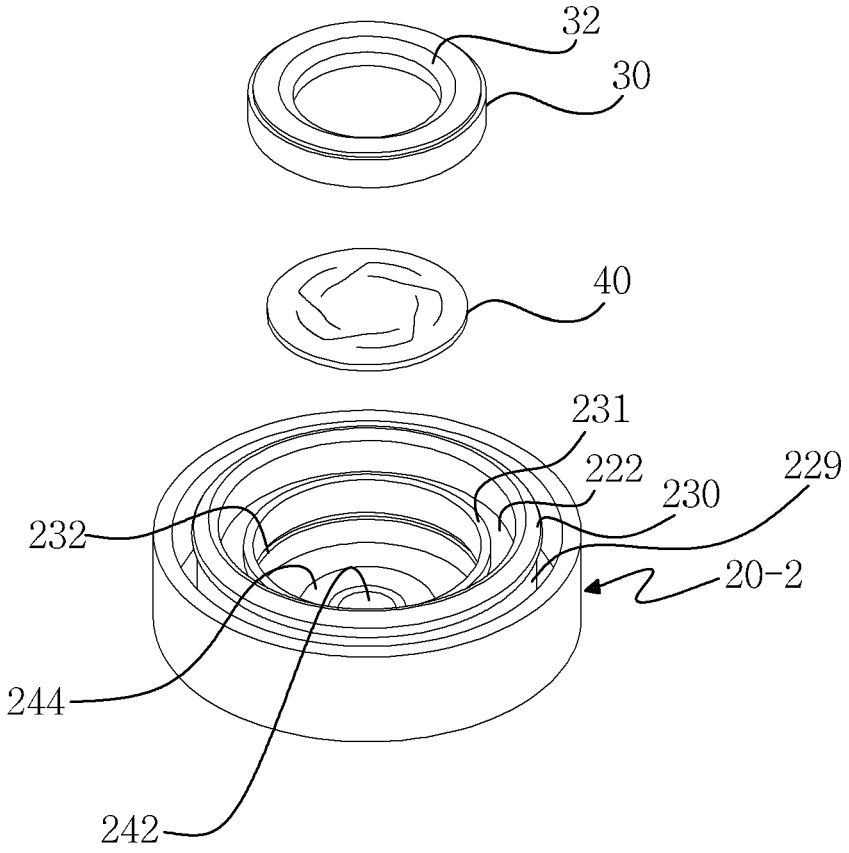
FIG. 14 is a perspective view showing a valve body, a valve place and a valve plate fixing member applied to the contents dispensing pump according to the second embodiment of the present invention.

FIG. 13 is an entire sectional view showing a contents dispensing pump according to a second embodiment of the present invention. FIG. 14 is a perspective view showing a valve body, a valve plate and a valve plate fixing member applied to the contents dispensing pump according to the second embodiment of the present invention.

As shown in FIGS. 13 and 14, the contents dispensing pump according to the second embodiment of the present invention is coupled to a container 10 for containing contents therein and includes a valve body 20-2, a valve plate fixing member 30, a valve plate 40, a push button 50, a deformed pressing member 60 and an elastic member 70.

Since the valve plate 40, the push button 50, the deformed pressing member 60 and the elastic member 70 are identical to those of the first embodiment, the details will be omitted. In the following description, the same elements and structures of the second embodiment as those of the first embodiment will be assigned with the same reference numerals.

The receiving sill 22 includes a receiving sill 222 formed on an upper surface thereof, an extension protrusion wheel 229 extending upwardly from an outer periphery of the receiving sill 222 and integrated with the receiving sill 222, and a latching sill 230 formed outwardly of an upper end of the extension protrusion wheel. In addition, a supplementary extension protrusion wheel 231 may be integrally formed upwardly of the inner periphery of the receiving sill 222.

A coupling sill 64 of the deformed pressing member 60 is mounted on the receiving sill 222 and the extension protrusion wheel 229 serves as a guide to enable the coupling sill 64 of the deformed pressing member 60 and the elastic member 70 to be in place. The supplementary extension protrusion wheel 231 serves as a guide to enable the coupling sill 64 of the deformed pressing meaner 60 to be in place and at the same time, improves the air tightness.

A contents outlet 242 is formed in the center of a lower end of the valve body 20-2 and a ring-shaped protrusion 244 protrudes from the vicinity of the outside of the contents outlet 242. A latching sill 232 may protrude from the middle portion of an inner periphery of the valve body 20-2.

The valve place fixing member 30 has a ring shape and is provided on an inner periphery of an upper surface thereof with a valve plate supporting sill 32.

According to the contents dispensing pump of the second embodiment, after the valve plate 40 is mounted on the ring-shaped protrusion 244 by inserting the valve plate 40 into the valve body 20-2, the valve plate fixing member 30 is inserted into the valve body 20-2 so that the valve plate fixing member 30 is fixed into the valve body 20-2 while the periphery of the valve plate 40 is pressed by the valve platy supporting sill 32.

In this case, the valve plate fixing member 30 may be fixed into the valve body 20-2 by being forcibly fitted with the valve body 20-2 and may be fixed by being latched over the latching sill 232 of the valve body 20-2.

Then, the deformed pressing member 60 is mounted on the valve body 20-2, and the extension protrusion wheel 225 and the supplementary extension protrusion wheel 231 of the valve body 20-2 surrounds the outer and inner peripheries of the coupling sill 64 of the deformed pressing member 60 while the latching sill 64 of the deformed pressing member 60.

After the elastic member 70 is placed on the coupling sill 64 of the deformed pressing member 60, the push button 50 is mounted on the deformed pressing member 60. That is, the coupling rib 53 of the push button 50 is fitted into the coupling groove 66 of the deformed pressing member 60, and the latching sill 52 of the push button 50 is latched to the extension protrusion sill 223 of the valve body 20-2 over the latching sill 230.

Since the operation of the contents dispensing pump according to the second embodiment of the present invention configured as described above is the same as that of the first embodiment, the description will be omitted.

Next, the contents dispensing pump according to the third embodiment of the present invention will be described.

Figure 15:
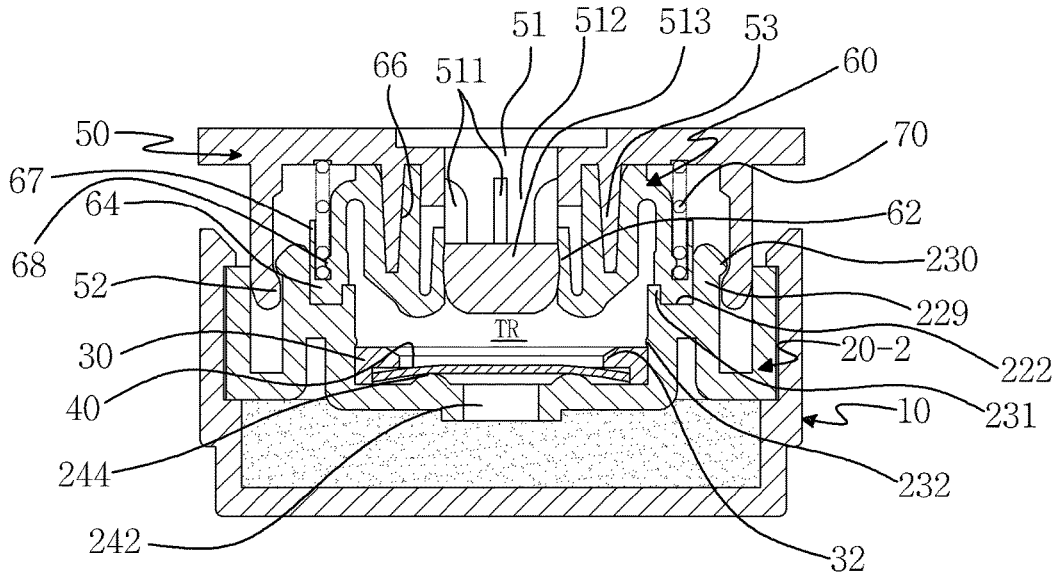
FIG. 15 is an entire sectional view showing a contents dispensing pump according to a third embodiment of the present invention.
Figure 16:
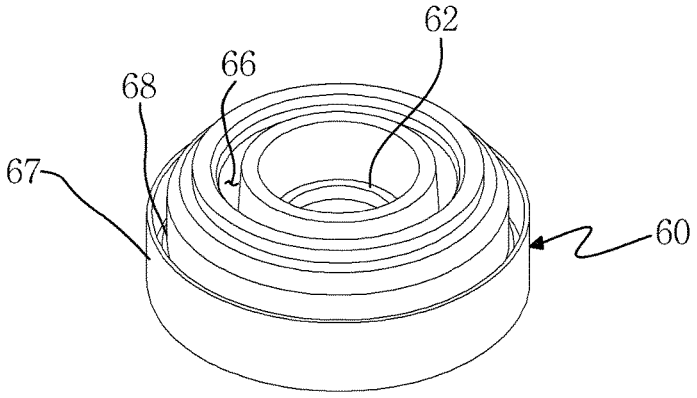
FIG. 16 is a perspective view showing a deformed pressing member applied to the contents dispensing pump according to the third embodiment of the present invention.

FIG. 15 is an entire sectional view showing a contents dispensing pump according to a third embodiment of the present invention. FIG. 16 is a perspective view showing a deformed pressing member applied to the contents dispensing pump according to the third embodiment of the present invention.

As shown in FIGS. 15 and 16, the contents dispensing pump according to the third embodiment of the present invention further includes an extension protrusion wheel 67 which is integrally formed on an outer periphery of the deformed pressing member 60. That is, the deformed pressing member 60 may be applied to the contents dispensing pump according to the first or second embodiment.

FIG. 15 is an entire sectional view showing the deformed pressing member 60 of the contents dispensing pump according to the third embodiment applied to the contents dispensing pump according to the second embodiment, but the embodiment is not limited thereto. Therefore, the contents dispensing pump according to the third embodiment will be described with reference to FIG. 15 showing that the deformed pressing member 60 of the contents dispensing pump according to the third embodiment is applied to the contents dispensing pump according to the second embodiment.

As shown in FIG. 15, the contents dispensing pump according to the third embodiment of the present invention is coupled to a container 10 for containing contents therein and includes a valve body 20-2, a valve plate fixing member 30, a valve plate 40, a push button 50, a deformed pressing member 60 and an elastic member 70.

The valve body 20-2 and the valve plate fixing member 30 are the same as those of the contents dispensing pump according to the second embodiment and the valve plate 40, the push button 50, the deformed pressing member 60 and the elastic member 70 are the same as those of the contents dispensing pump according to the first embodiment. Thus, the descriptions will be omitted.

The deformed pressing member 60 includes an extension protrusion wheel 67 which extends upwardly of the outer periphery of the coupling sill 64 of the deformed pressing member 60 to be integrally formed with the coupling sill 64. The extension protrusion wheel 67 may serve as a guide to enable the elastic member 70 to easily be in place when the elastic member 70 is mounted on the coupling sill 64 of the deformed pressing member 60.

In addition, a latching sill 58 may be further formed upwardly of the inner periphery of the latching sill 64 of the deformed pressing member 60. After the elastic member 70 is mounted on the coupling sill 64 of the deformed pressing member 60, the elastic member 70 is latched to the latching sill 68, so that the latching sill 68 prevents the elastic member 70 from being out of the place.

Since the structure of the contents dispensing pump according to the third embodiment is the same as that of the contents dispensing pump of the second embodiment except for the deformed pressing member 60, the details will be omitted. In addition, since the operation of the contents dispensing pump according to the third embodiment is the same as that of the contents dispensing pump according to the first embodiment, the details will be omitted.

Next, the contents dispensing pump according to the fourth embodiment of the present invention will be described.

Figure 17:
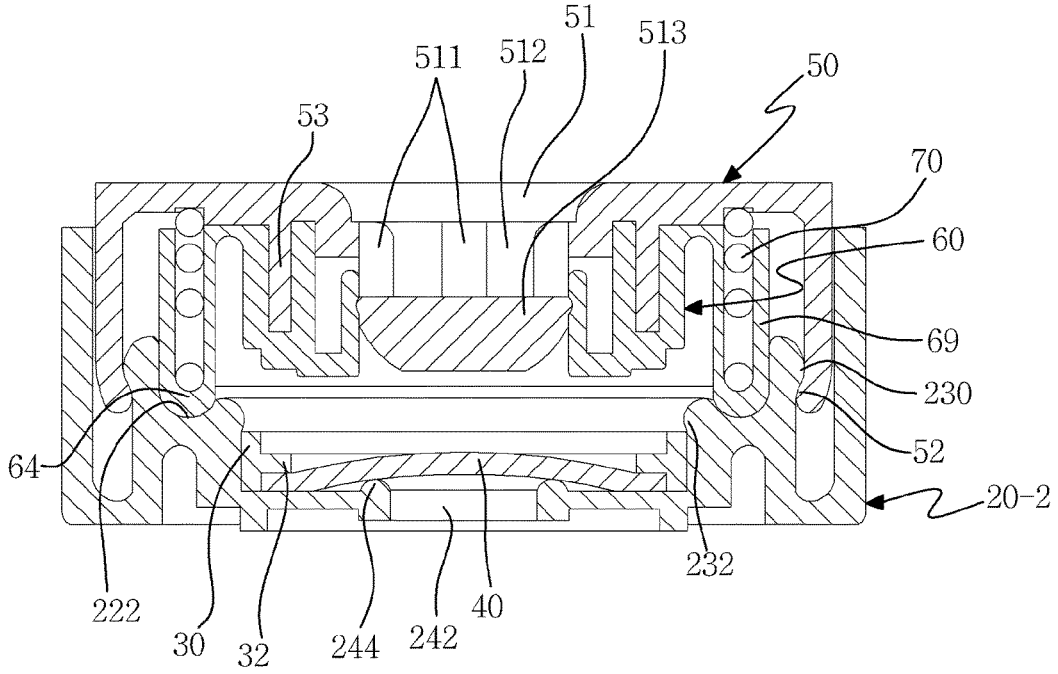
FIG. 17 is an entire sectional view showing a contents dispensing pump according to a fourth embodiment of the present invention.

FIG. 17 is an entire sectional view showing a contents dispensing pump according to a fourth embodiment of the present invention.

As shown in FIG. 17, the contents dispensing pump according to the fourth embodiment of the present invention further includes a long extension protrusion wheel 69 which is integrally formed on an outer periphery of the deformed pressing member 60 and has a height equal to that of the uppermost side surface of the deformed pressing member 60 to surround the entire elastic member 70. The deformed pressing member 60 may be applied to the contents dispensing pump according to the first or second embodiment.

FIG. 17 is an entire sectional view showing the deformed pressing member 60 of the contents dispensing pump according to the fourth embodiment applied to the contents dispensing pump according to the second embodiment, but the embodiment is not limited thereto. Therefore, the contents dispensing pump according to the fourth embodiment will be described with reference to FIG. 17.

The contents dispensing pump according to the fourth embodiment of the present invention is coupled to a container 10 for containing contents therein and includes a valve body 20-2, a valve plate fixing member 30, a valve plate 40, a push button 50, a deformed pressing member 60 and an elastic member 70.

The valve body 20-2 and the valve plate fixing member 30 are the same as those of the contents dispensing pump according to the second embodiment and the valve plate 40, the push button 50, the deformed pressing member 60 and the elastic member 70 are the same as those of the contents dispensing pump according to the first embodiment. Thus, the descriptions will be omitted.

The deformed pressing member 60 is provided with a long extension protrusion wheel 69 which is integrally formed on an outer periphery of the coupling sill 64 of the deformed pressing member 60 and has a height equal to that of the uppermost side surface of the deformed pressing member 60 to surround the entire elastic member 70.

The long extension protrusion wheel 69 prevents the elastic member 70 from being out of place and supplements the elastic operation of the elastic member 70 after the elastic member 70 is mounted on the coupling sill 64 of the deformed pressing member 60. That is, when the push button 50 is pushed, the elastic member 70 is compressed to generate elastic force. In this case, the long extension protrusion wheel 63 is also is compressed to generate elastic force.

Then, when the force pressing the push button 50 is removed, the elastic member 70 lifts the push button 50 due to the elastic force. In this case, the long extension protrusion wheel 63 lifts the push button 50 together with the elastic member 70 due to the elastic force.

Since the structure of the contents dispensing pump according to the fourth embodiment is the same as that of the contents dispensing pump of the second embodiment except for the deformed pressing member 60, the details will be omitted. In addition, since the operation, of the contents dispensing pump according to the fourth embodiment is the same as that, of the contents dispensing pump according to the first embodiment, the details will be omitted.

Next, the contents dispensing pump according to the fifth embodiment of the present invention will be described.

Figure 18:
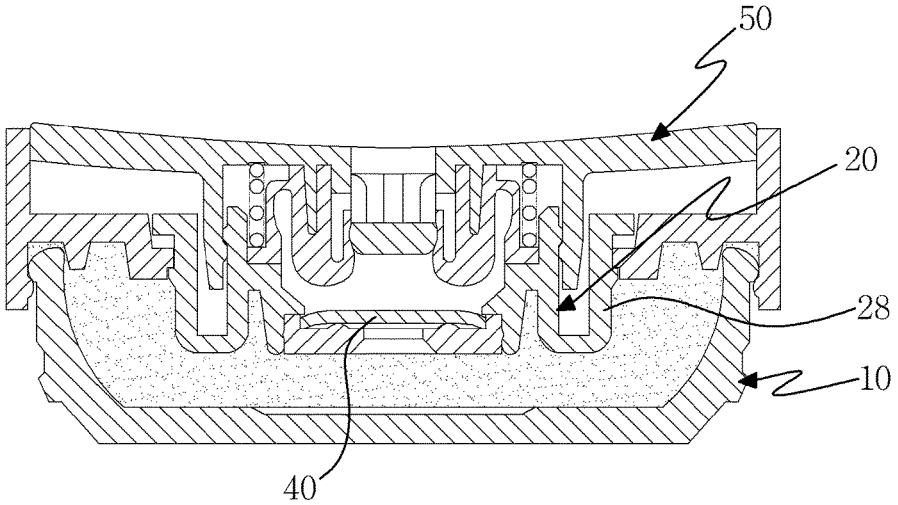
FIG. 18 is an entire sectional view showing a contents dispensing pump according to a fifth embodiment of the present invention.

FIG. 18 is an entire sectional view showing a contents dispensing pump according to a fifth embodiment of the present invention, where the contents dispensing pump is coupled to a flat container 10 such as a compact.

As shown in FIG. 18, the contents dispensing pump according to the fifth embodiment of the present invention may be coupled to the container 10 for containing contents therein and a coupling protrusion wheel 28 for coupling with the container 10 may be further formed on the outermost portion of the valve body 20.

The contents dispensing pump is only for an illustrative purpose, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container
20: Valve body
22: Valve upper body
222: Receiving sill
24: Valve lower body
242: Contents outlet
244: Ring-shaped protrusion
30: Valve plate fixing member
40: Valve plate
41: Cutting line
50: Push button
51: Outlet
511: Rib
512: Contents passage
513: Contents opening and closing piece
60: Deformed pressing member
62: Valve protrusion wheel
64: Coupling sill
70: Elastic member
TR: Temporary reservoir

The invention claimed is:

1. A contents dispensing pump coupled to a container for containing the contents therein to dispense the contents, the contents dispensing pump comprising:

a deformed pressing member (60) to descend by being pressed and deformed when a push button (50) descends such that a volume of a temporary reservoir (TR) is reduced to generate a pressure in the temporary reservoir (TR), and a valve plate (40) to close a contents outlet (242) when the pressure is generated in the temporary reservoir (TR), wherein a valve protrusion wheel (62) of the deformed pressing member (60) coming into close contact with a contents opening and closing piece (513) is widened by the pressure such that the contents contained in the temporary reservoir (TR) are dispensed through an outlet (51) while passing through a gap between the contents opening and closing piece (513) and the valve protrusion wheel (62), wherein, when the pressure that presses the push button (50) is removed, the push button (50) lifts up by a restoring force of an elastic member (70) and the deformed pressing member (60) pressed by the push button (50) is restored to the original state, so the pressure generated in the temporary reservoir (TR) disappears and vacuum pressure is generated, so that the gap between the contents opening and closing piece (513) and the valve protrusion wheel (62) of the deformed pressing member (60) is closed and a central part of the valve plate (40) is lifted by the vacuum pressure to widen boundary lines of opening and closing lines (41), wherein the contents contained in the container (10) move to the temporary reservoir (TR) through a gap between the valve plate (40) and the contents outlet (242), and in this case, the contents that have passed through the contents outlet (242) move to the temporary reservoir (TR) through gaps of widened opening and closing lines (41) of the valve plate (40), and wherein, when the vacuum pressure of the temporary reservoir (TR) disappears due to movement of the contents, an opening and closing line (41) opened due to elastic force of the valve plate (40) is restored into the original state to be closed so that the valve plate (40) closes the contents outlet (242).

2. The contents dispensing pump of claim 1, further comprising a coupling sill (64) protruding from an outer periphery of the deformed pressing member (60).

3. The contents dispensing pump of claim 1, wherein a plurality of ribs (511) are formed inside the outlet (51), the contents opening and closing piece (513) is formed on lower ends of the ribs (511), and a contents passage (512) is formed between the ribs (511).

4. The contents dispensing pump of claim 1, wherein a coupling rib (53) is formed inside the push button (50), a coupling groove (66) is formed on an upper surface of the deformed pressing member (60), and the coupling rib (53) of the push button (50) is inserted into the coupling groove (66).

5. The contents dispensing pump of claim 1, wherein the elastic member (70) is positioned over a coupling sill (64) of the deformed pressing member (60) so as to press and fix the coupling sill (64) of the deformed pressing member (60) to a receiving sill (222) of a valve upper body (22) of the valve body (20), thereby increasing airtightness and elastically supporting the push button (50).

6. The contents dispensing pump of claim 1, wherein the contents opening and closing piece (513) of the push button (50) is tightly fitted into the valve protrusion wheel (62) of the deformed pressing member (60) to control dispensing of the contents.

7. A contents dispensing pump coupled to a container for containing the contents therein to dispense the contents, the contents dispensing pump comprising:

a valve body (20) including a valve upper body (22) and a valve lower body (24) coupled to each other, in which the valve upper body (22) has a receiving sill (222) formed on an upper surface of the valve upper body (22) and a contents outlet (242) formed at a center of the valve lower body (24);

a valve plate (40) coupled between the valve upper body (22) and the valve lower body (24) of the valve body (20);

a push button (50) coupled onto the valve upper body (22) and provided at a center thereof with an outlet (51) through which the contents dispensed, in which a contents opening and closing piece (513) is provided at a lower portion of an inside of the outlet (51);

a deformed pressing member (60) coupled to an inside of the push button (50), mounted on the valve upper body (22) and provided at a center thereof with a valve protrusion wheel (62); and an elastic member (70) to elastically support the push button (50) by pressing an end of an outer periphery surface of the deformed pressing member (60).

8. The contents dispensing pump of claim 7, further comprising a coupling sill (64) protruding from an outer periphery of the deformed pressing member (60).

9. The contents dispensing pump of claim 7, wherein a plurality of ribs (511) are formed inside the outlet (51), a contents opening and closing piece (513) is formed on lower ends of the ribs (511), and a contents passage (512) is formed between the ribs (511).

10. The contents dispensing pump of claim 7, wherein a coupling rib (53) is formed inside the push button (50), a coupling groove (66) is formed on an upper surface of the deformed pressing member (60), and the coupling rib (53) of the push button (50) is inserted into the coupling groove (66).

11. The contents dispensing pump of claim 7, wherein the elastic member (70) is positioned over a coupling sill (64) of the deformed pressing member (60) so as to press and fix the coupling sill (64) of the deformed pressing member (60) to the receiving sill (222) of the valve upper body (22), thereby increasing airtightness and elastically supporting the push button (50).

12. The contents dispensing pump of claim 7, wherein the contents opening and closing piece (513) of the push button (50) is tightly fitted into the valve protrusion wheel (62) of the deformed pressing member (60) to control dispensing of the contents.

13. A contents dispensing pump coupled to a container for containing the contents therein to dispense the contents, the contents dispensing pump comprising:

a valve body (20-2) including a contents outlet (242) formed at a center thereof and a receiving sill (222) formed on an upper surface thereof;

a valve plate fixing member (30) coupled to an inside of the valve body (20-2), in which the valve plate fixing member (30) has a ring shape and is provided on an inner periphery of an upper surface thereof with a valve plate supporting sill (32);

a valve plate (40) coupled between the valve body (20-2) and the valve plate fixing member (30);

a push button (50) coupled onto the valve body (20-2) and provided at a center thereof with an outlet (51) through which the contents dispensed, in which a contents opening and closing piece (513) is provided at a lower portion of an inside of the outlet (51);

a deformed pressing member (60) coupled to an inside of the push button (50), mounted on the valve body (20-2) and provided at a center thereof with a valve protrusion wheel (62); and an elastic member (70) to elastically support the push button (50) by pressing an end of an outer periphery surface of the deformed pressing member (60).

14. The contents dispensing pump of claim 13, further comprising a coupling sill (64) protruding from an outer periphery of the deformed pressing member (60).

15. The contents dispensing pump of claim 13, wherein a plurality of ribs (511) are formed inside the outlet (51), a contents opening and closing piece (513) is formed on lower ends of the ribs (511), and a contents passage (512) is formed between the ribs (511).

16. The contents dispensing pump of claim 13, wherein a coupling rib (53) is formed inside the push button (50), a coupling groove (66) is formed on an upper surface of the deformed pressing member (60), and the coupling rib (53) of the push button (50) is inserted into the coupling groove (66).

17. The contents dispensing pump of claim 13, wherein the elastic member (70) is positioned over a coupling sill (64) of the deformed pressing member (60) so as to press and fix the coupling sill (64) of the deformed pressing member (60) to the receiving sill (222) of the valve body (20-2), thereby increasing airtightness and elastically supporting the push button (50).

18. The contents dispensing pump of claim 13, wherein a contents opening and closing piece (513) of the push button (50) is tightly fitted into the valve protrusion wheel (62) of the deformed pressing member (60) to control dispensing of the contents.

* * * * *